US011072173B2

(12) United States Patent
Miyazaki

(10) Patent No.: US 11,072,173 B2
(45) Date of Patent: Jul. 27, 2021

(54) HEAD MODULE, HEAD UNIT, LIQUID DISCHARGE HEAD, AND LIQUID DISCHARGE APPARATUS

(71) Applicant: Takeshi Miyazaki, Kanagawa (JP)

(72) Inventor: Takeshi Miyazaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/812,475

(22) Filed: Mar. 9, 2020

(65) Prior Publication Data

US 2020/0298567 A1 Sep. 24, 2020

(30) Foreign Application Priority Data

Mar. 19, 2019 (JP) ..... JP2019-050604

(51) Int. Cl.
*B41J 2/14* (2006.01)

(52) U.S. Cl.
CPC ..... *B41J 2/1433* (2013.01); *B41J 2/14201* (2013.01)

(58) Field of Classification Search
CPC ..... B41J 2/1433; B41J 2/14201
See application file for complete search history.

(56) References Cited

U.S. PATENT DOCUMENTS

2012/0069101 A1 3/2012 Kato et al.
2012/0206540 A1 8/2012 Kato et al.
2012/0206545 A1 8/2012 Kato et al.
2012/0212545 A1 8/2012 Mizukami et al.
2012/0229573 A1 9/2012 Mizukami et al.
2012/0236083 A1 9/2012 Mizukami et al.
2012/0320131 A1 12/2012 Kato et al.
2013/0021412 A1 1/2013 Nishimura et al.
2013/0050354 A1 2/2013 Kato et al.
2013/0070021 A1 3/2013 Nishimura et al.
2015/0266295 A1 9/2015 Miyazaki
2017/0001441 A1 1/2017 Kato
2017/0106650 A1 4/2017 Miyazaki
2017/0151782 A1 6/2017 Takahashi et al.
2019/0263157 A1 8/2019 Miyazaki
2019/0270310 A1 9/2019 Masuda et al.
2019/0275793 A1 9/2019 Kato
2019/0275797 A1 9/2019 Kato
2020/0290354 A1* 9/2020 Shimosato ..... B41J 2/1643
2020/0307212 A1* 10/2020 Takabe ..... B41J 2/14233

FOREIGN PATENT DOCUMENTS

JP 2011-056922 3/2011
JP 2013-169749 9/2013

* cited by examiner

*Primary Examiner* — Lamson D Nguyen
(74) *Attorney, Agent, or Firm* — Oblon, McClelland, Maier & Neustadt, L.L.P.

(57) ABSTRACT

A head module includes a head and a cover. The head includes a nozzle plate and a channel substrate. The nozzle plate includes a nozzle configured to discharge liquid from a discharge surface of the nozzle plate. The channel substrate includes an individual channel communicated with the nozzle. The channel substrate has a surface facing the nozzle plate. The cover covers at least one side of the discharge surface of the nozzle plate of the head. An outer shape of the nozzle plate is smaller than an outer shape of the channel substrate. The cover has a bonded surface bonded to the surface of the channel substrate in an outer area of the nozzle plate with an adhesive. The bonded surface of the cover is closer to the channel substrate than the discharge surface of the nozzle plate is.

17 Claims, 15 Drawing Sheets

HEAD MODULE, HEAD UNIT, LIQUID DISCHARGE HEAD, AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-050604, filed on Mar. 19, 2019, in the Japan Patent Office, the entire disclosure of which is incorporated by reference herein.

BACKGROUND

Technical Field

Aspects of the present disclosure relate to a head module, a head unit, a liquid discharge head, and a liquid discharge apparatus.

Related Art

As a head that discharges liquid (liquid discharge head), there is known a liquid discharge head with a cover that covers a peripheral edge of a nozzle surface of the head on which nozzles are formed.

SUMMARY

In an aspect of the present disclosure, there is provided a head module that includes a head and a cover. The head includes a nozzle plate and a channel substrate. The nozzle plate includes a nozzle configured to discharge liquid from a discharge surface of the nozzle plate. The channel substrate includes an individual channel communicated with the nozzle. The channel substrate has a surface facing the nozzle plate. The cover covers at least one side of the discharge surface of the nozzle plate of the head. An outer shape of the nozzle plate is smaller than an outer shape of the channel substrate. The cover has a bonded surface bonded to the surface of the channel substrate in an outer area of the nozzle plate with an adhesive. The bonded surface of the cover is closer to the channel substrate than the discharge surface of the nozzle plate is.

In another aspect of the present disclosure, there is provided a head unit that includes a common base and a plurality of head modules, including the head module, on the common base.

In still another aspect of the present disclosure, there is provided a liquid discharge head that includes a nozzle plate, a channel substrate, and a cover. The nozzle plate includes a nozzle configured to discharge liquid from a discharge surface of the nozzle plate. The channel substrate includes an individual channel communicated with the nozzle. The cover covers at least one side of the discharge surface of the nozzle plate. An outer shape of the nozzle plate is smaller than an outer shape of the channel substrate. The cover has a bonded surface bonded to the surface of the channel substrate in an outer area of the nozzle plate with an adhesive. The bonded surface of the cover is closer to the channel substrate than the discharge surface of the nozzle plate.

In still yet another aspect of the present disclosure, there is provided a liquid discharge apparatus including the liquid discharge head.

In still yet another aspect of the present disclosure, there is provided a liquid discharge apparatus including the head unit.

In still yet another aspect of the present disclosure, there is provided a liquid discharge apparatus including the head module.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
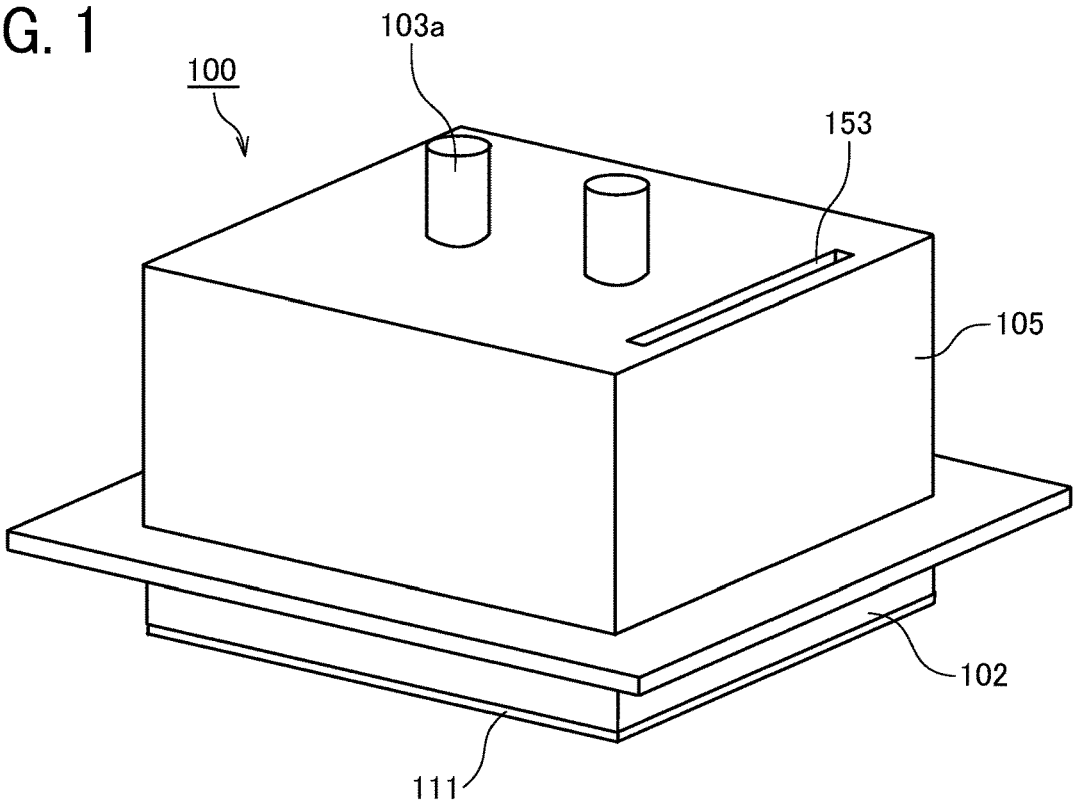
FIG. 1 is an outer perspective view of a head module according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
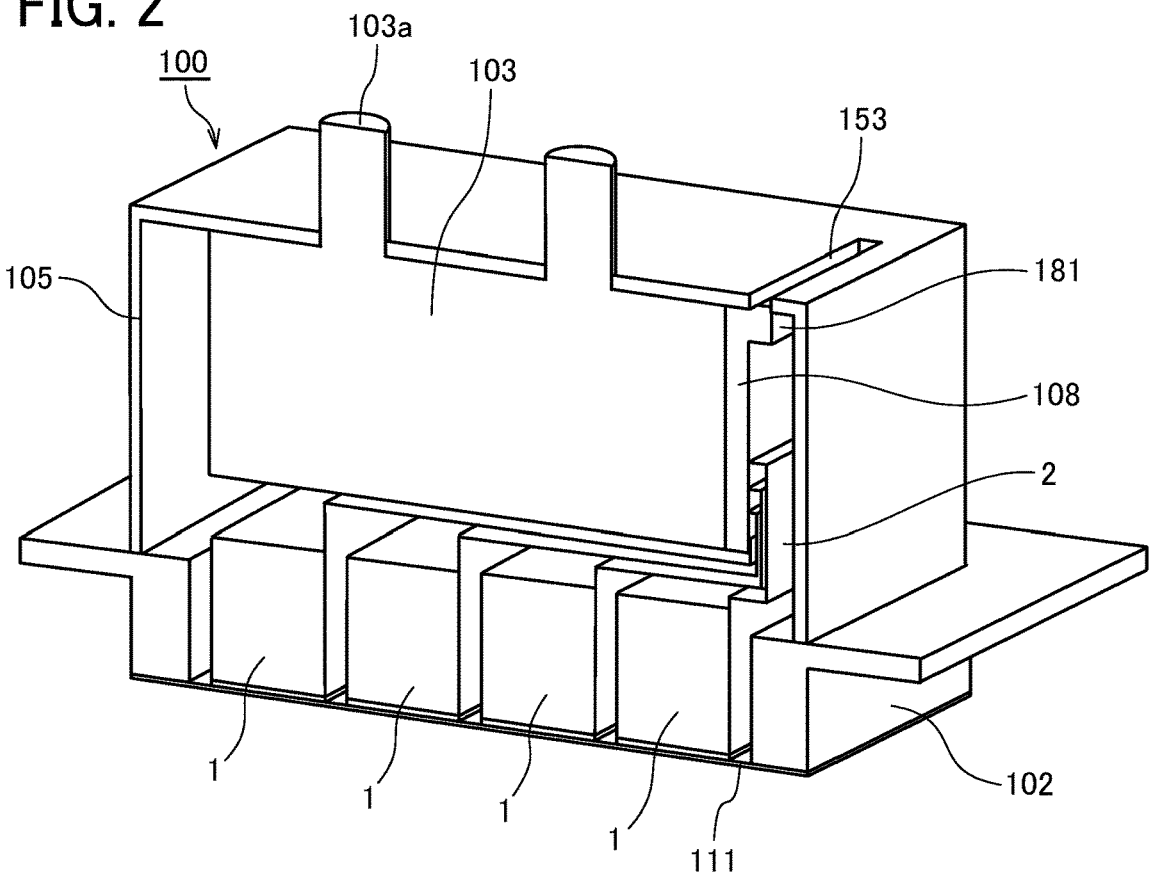
FIG. 2 is a cross-sectional perspective view of the head module cut along a head arrangement direction.
Figure 3:
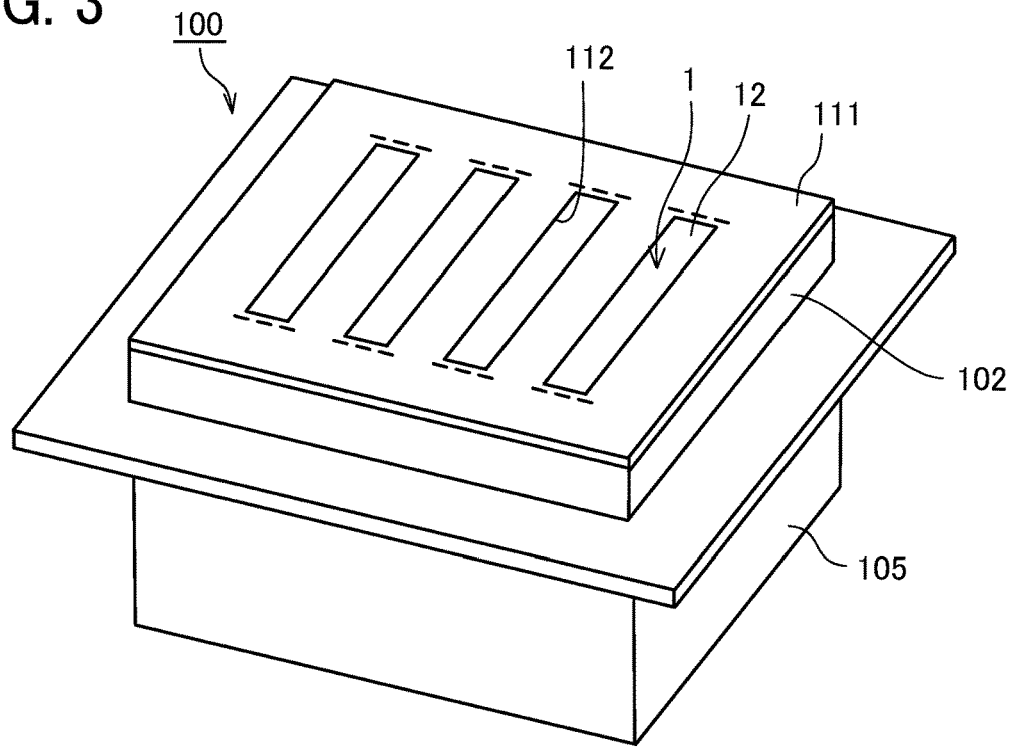
FIG. 3 is an outer perspective view of the head module as seen from a cover side.
Figure 4:
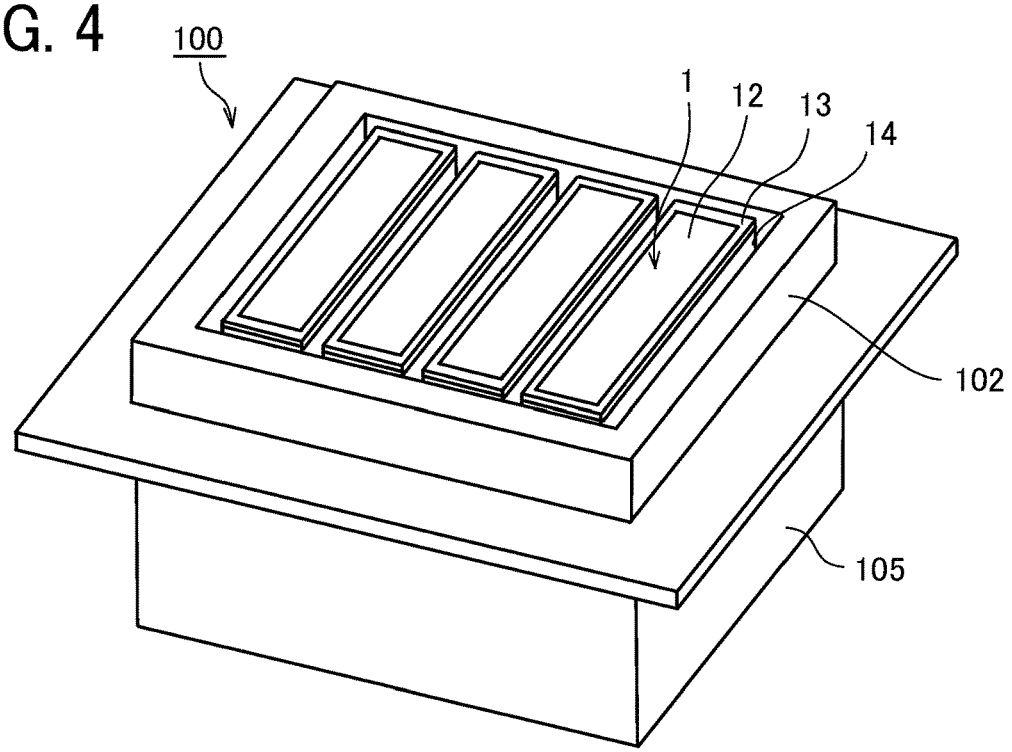
FIG. 4 is a perspective view of the head module similar to FIG. 3 in a state in which a cover is detached.

A first embodiment of the present disclosure is described with reference to FIGS. 1 to 5. FIG. 1 is an outer perspective view of a head module according to the first embodiment. FIG. 2 is a perspective cross-sectional view of the head module cut along a head arrangement direction. FIG. 3 is an outer perspective view of the head module as seen from a cover side. FIG. 4 is a perspective view of the head module similar to FIG. 3 in a state in which a cover is detached.

A head module 100 includes a plurality of (herein, four) heads 1 being liquid discharge heads that discharge liquid. A wiring member 2 such as a flexible printed circuit (FPC) is extracted from the head 1.

The head 1 includes a nozzle plate 12 on which nozzles 11 that discharge liquid are formed, a channel substrate 13 that forms an individual channel communicated with the nozzles 11, a holding substrate 14, and a frame member 15. In the head 1, an outer shape of the nozzle plate 12 is smaller than an outer shape of the channel substrate 13.

The plurality of heads 1 is held on a base 102. The base 102 includes a cover 111 that covers a peripheral edge of a discharge surface (nozzle surface) 12*a* of the nozzle plate 12 of each head 1 attached thereto. In this embodiment, the cover 111 covers the peripheral edges of all sides of the discharge surface 12*a* of each head 1, and includes an opening 112 corresponding to each head 1.

In the head module 100, a channel component 103 including a channel for supplying liquid to each head 1 and a printed circuit board 108 to which the wiring member 2 is connected are arranged above the plurality of heads 1, and the channel component 103 and the printed circuit board 108 are accommodated in a case member 105. A liquid port 103*a* is connected to the channel component 103.

The printed circuit board 108 is provided with a connector 181. The case member 105 is provided with an opening 153 that allows external access to the connector 181 and the like.

Figure 5:
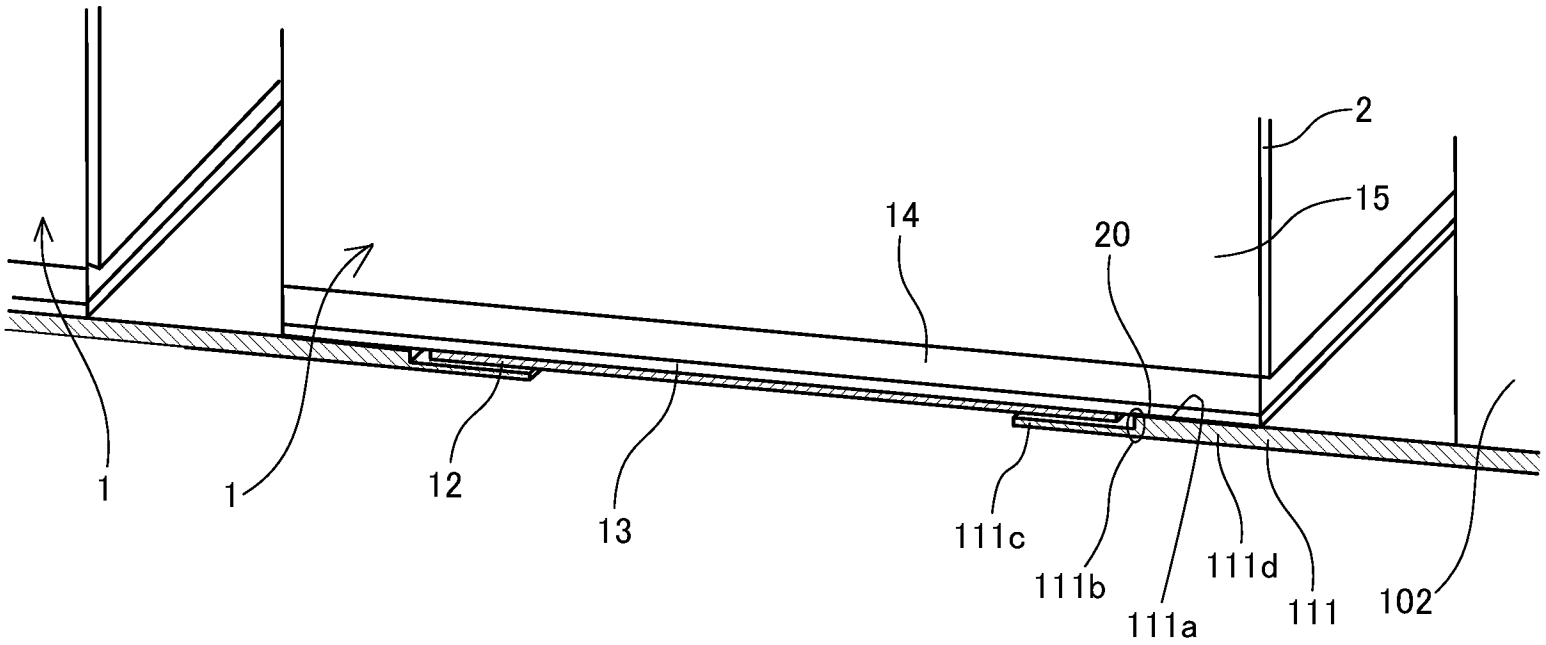
FIG. 5 is a cross-sectional perspective view of an attachment portion between heads and the cover in the first embodiment.
Figure 6:
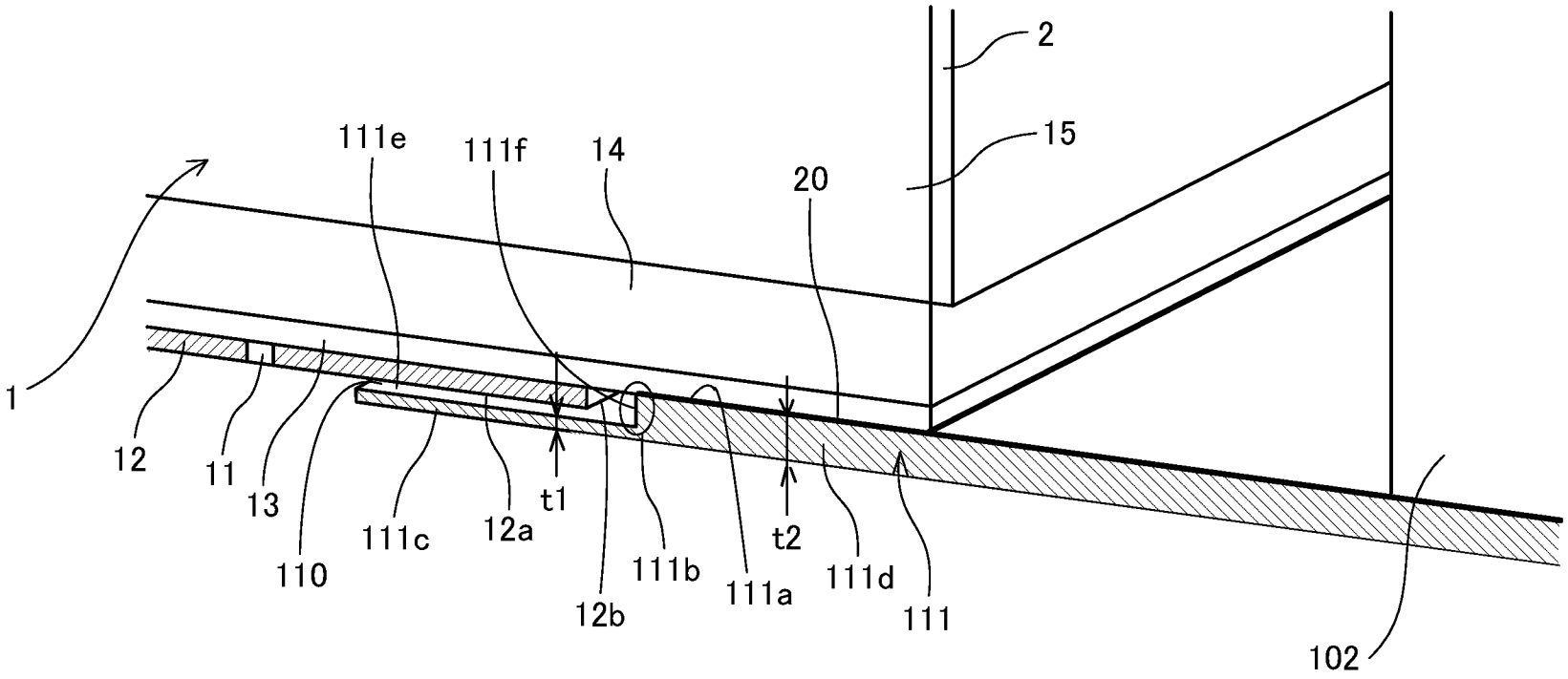
FIG. 6 is an enlarged cross-sectional perspective view of the attachment portion of FIG. 5.
Figure 7:
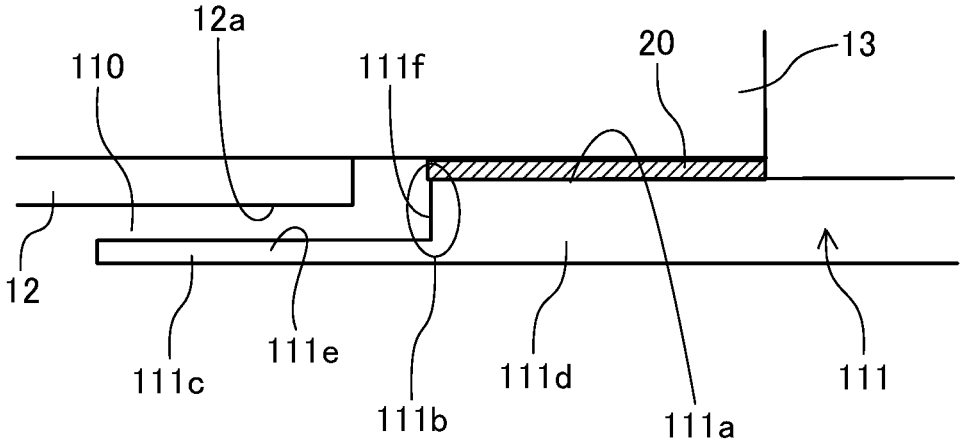
FIG. 7 is an enlarged cross-sectional illustrative view of the attachment portion of FIG. 5.

Next, the cover in this embodiment is described in detail with reference to FIGS. 5 to 7, too. FIG. 5 is a cross-sectional perspective view of an attachment portion between the head and the cover. FIG. 6 is an enlarged cross-sectional perspective view of the attachment part of FIG. 5. FIG. 7 is an enlarged cross-sectional view of the attachment part of FIG. 5.

The cover 111 has a bonded surface 111*a* bonded to a surface of the channel substrate 13, which faces the nozzle plate 12, with an adhesive 20 in an outer area of the nozzle plate 12. The bonded surface 111*a* of the cover 111 to the channel substrate 13 is located closer to the channel substrate 13 than the discharge surface 12*a* of the nozzle plate 12 is.

The cover 111 includes a step portion 111*b* on a side facing the channel substrate 13. The step portion 111*b* includes the bonded surface 111*a* bonded to the channel substrate 13, an opposite surface 111*e* of an opposite portion 111*c* opposite the peripheral edge of the discharge surface 12*a* of the nozzle plate 12, and a connecting surface 111*f* that connects the bonded surface 111*a* to the opposite surface 111*e*.

Due to the step portion 111*b*, in the cover 111, a thickness t1 of the opposite portion 111*c* opposite the peripheral edge of the discharge surface 12*a* of the nozzle plate 12 is less than a thickness t2 of a bonded portion 111*d* bonded to the channel substrate 13.

With such a configuration, the cover 111 may cover the peripheral edge of the nozzle plate 12 to protect an edge of the nozzle plate 12 with a decreased thickness of the adhesive 20 that bonds the cover 111 to the channel substrate 13.

Between the opposite portion 111*c* opposite the peripheral edge of the discharge surface 12*a* of the cover 111 and the discharge surface 12*a*, a gap 110 is provided.

With such a configuration, the adhesive 20 that bonds the cover 111 to the channel substrate 13 may be made thin.

Between the opposite portion 111*c* opposite the peripheral edge of the discharge surface 12*a* of the cover 111 and the discharge surface 12*a*, a gap 110 is provided. As a result, the cover 111 does not move due to a change in temperature or the like, so that reliability is improved.

Since the gap 110 is not filled with the adhesive 20, the discharge surface 12*a* of the nozzle plate 12 and the cover 111 are not bonded to each other with the adhesive.

As a result, on the discharge surface 12*a* of the nozzle plate 12, a liquid repellent film (also referred to as a water repellent film or an ink repellent film) may be formed not only in the vicinity of the nozzles 11 but also to the peripheral edge of the discharge surface 12*a* of the nozzle plate 12. With such a configuration, liquid adhering to the vicinity of the peripheral edge of the discharge surface 12*a* may be easily removed from the discharge surface 12*a*.

Figure 8:
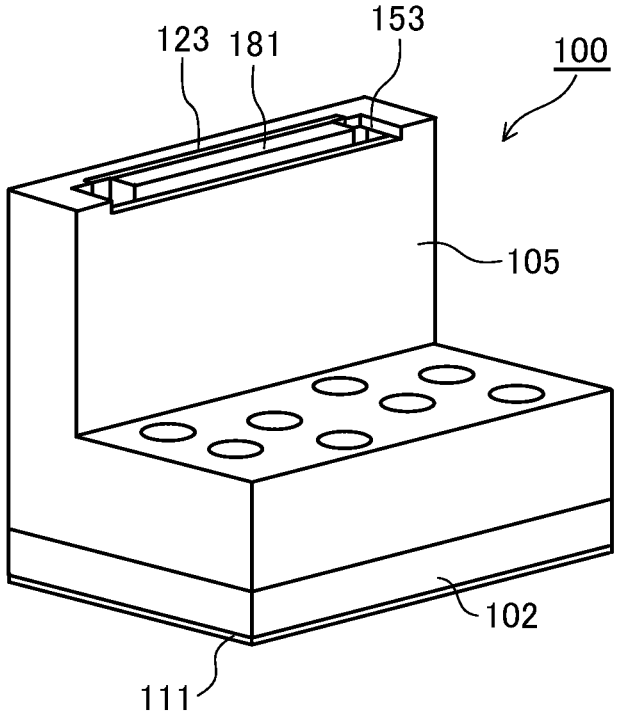
FIG. 8 is an outer perspective view of the head module according to a second embodiment of the present disclosure.
Figure 9:
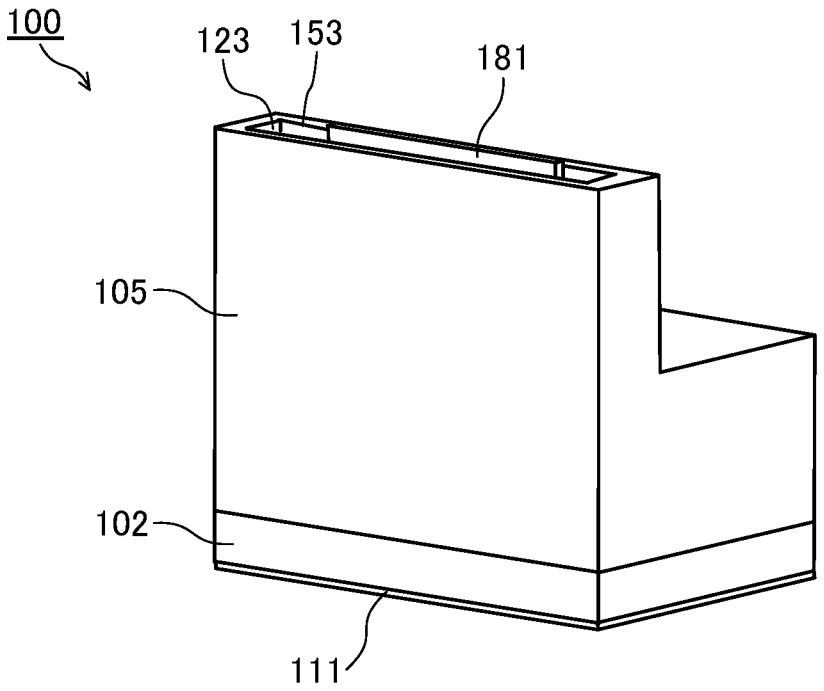
FIG. 9 is an outer perspective view of the head module according to the second embodiment as seen from the opposite side of FIG. 8.
Figure 10:
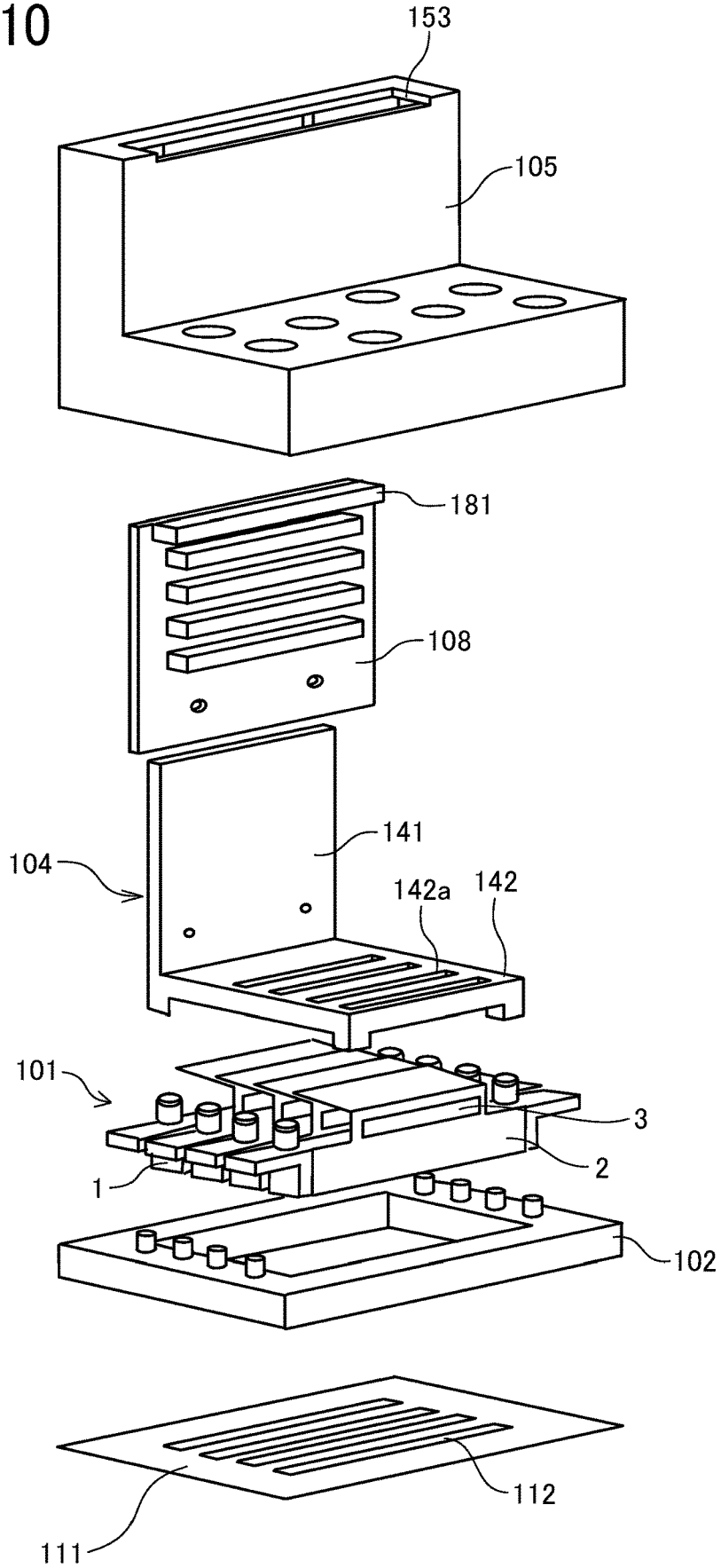
FIG. 10 is an exploded perspective view of the head module according to the second embodiment.
Figure 11:
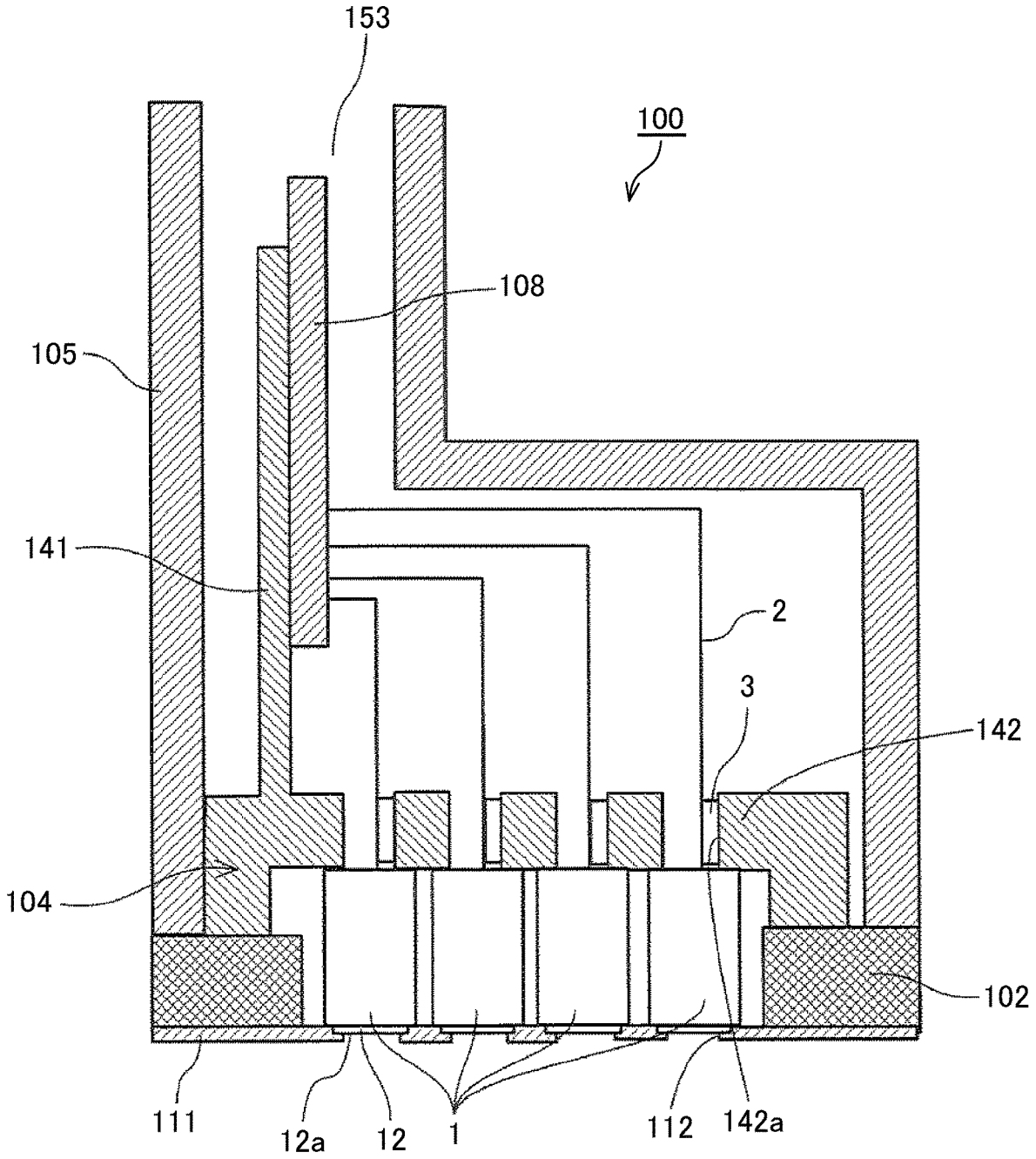
FIG. 11 is a schematic cross-sectional diagram of the head module according to the second embodiment.

Next, a second embodiment of the present disclosure is described with reference to FIGS. 8 to 11. FIG. 8 is an outer perspective view of a head module according to the second embodiment. FIG. 9 is an outer perspective view of the head module according to the second embodiment as seen from the opposite side of FIG. 8. FIG. 10 is an exploded perspective view of the head module according to the second embodiment. FIG. 11 is a schematic cross-sectional diagram of the head module according to the second embodiment.

A head module 100 includes a plurality of (herein, four) sub-head modules 101 each including a head 1, a wiring member 2 such as an FPC connected to the head 1, and an element 3 such as a drive integrated circuit (IC) mounted on the wiring member 2.

A base 102 that holds the four sub-head modules 101 is provided. To a lower surface of the base 102 (a surface on a discharge surface side of the head 1), a cover 111 that covers a peripheral edge of a discharge surface 12*a* of a nozzle plate 12 of each head 1 of the sub-head module 101 is attached as in the first embodiment. Since the configuration of the cover 111 and the configuration of the adhesive bonding of the cover 111 to each head 1 are similar to those in the first embodiment, description thereof is omitted.

The head module 100 includes a heat radiating member 104 thermally coupled to the element 3 mounted on the wiring member 2 of the sub-head module 101 and a case member 105 that surrounds at least the heat radiating member 104.

The term "coupled" is intended to mean a configuration in which the element 3 and the heat radiating member 104 are coupled via a member having thermal conductivity (for example, a heat conductive tape), a configuration in which the element 3 is pressed against the heat radiating member 104 by an elastic member such as a spring to be in direct contact therewith and coupled thereto and the like. A configuration in which a base material of the wiring member 2 on which the element 3 is mounted is coupled to the heat radiating member 104 via a member having thermal conductivity is also possible.

Herein, the heat radiating member 104 is preferably a metal material (metal member) having high thermal conductivity, and examples thereof may include metal including aluminum, silver, copper, and gold.

The heat radiating member 104 includes a first plate-shaped portion 141 including a main surface in a direction of gravity and a second plate-shaped portion 142 including a main surface in a horizontal direction. Herein, the first plate-shaped portion 141 is a plate-shaped portion in a direction perpendicular to the discharge surface 12*a*, and the second plate-shaped portion 142 is a plate-shaped portion in an in-plane direction of the discharge surface 12*a*. The heat radiating member 104 is a member in which the first plate-shaped portion 141 and the second plate-shaped portion 142 form a substantially L-shape.

The second plate-shaped portion 142 of the heat radiating member 104 is provided with a through-hole 142*a* through which the wiring member 2 passes and this couples a wall surface of the through-hole 142*a* and the element 3 on the wiring member 2.

To the first plate-shaped portion 141 of the heat radiating member 104, a printed circuit board 108 is fixed to be connected to each head 1 by the wiring member 2.

Figure 12:
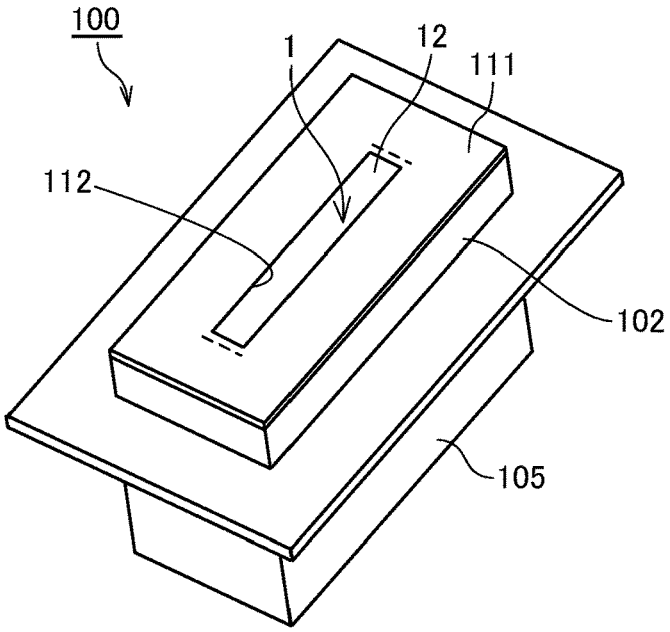
FIG. 12 is an outer perspective view of the head module according to a third embodiment of the present disclosure.
Figure 13:
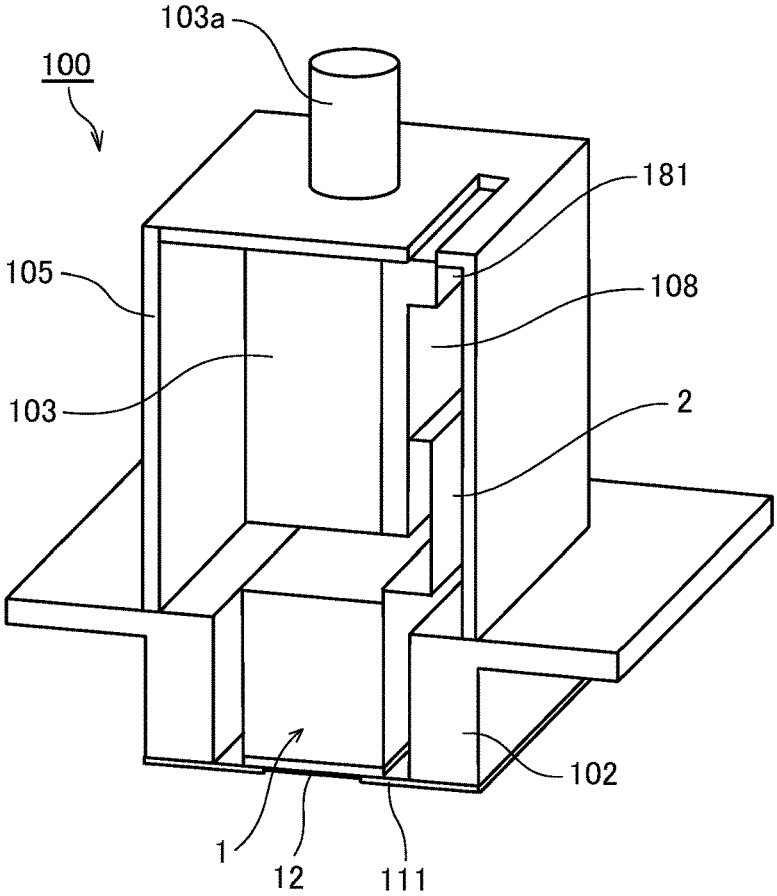
FIG. 13 is a cross-sectional perspective view of the head module according to the third embodiment.
Figure 14:
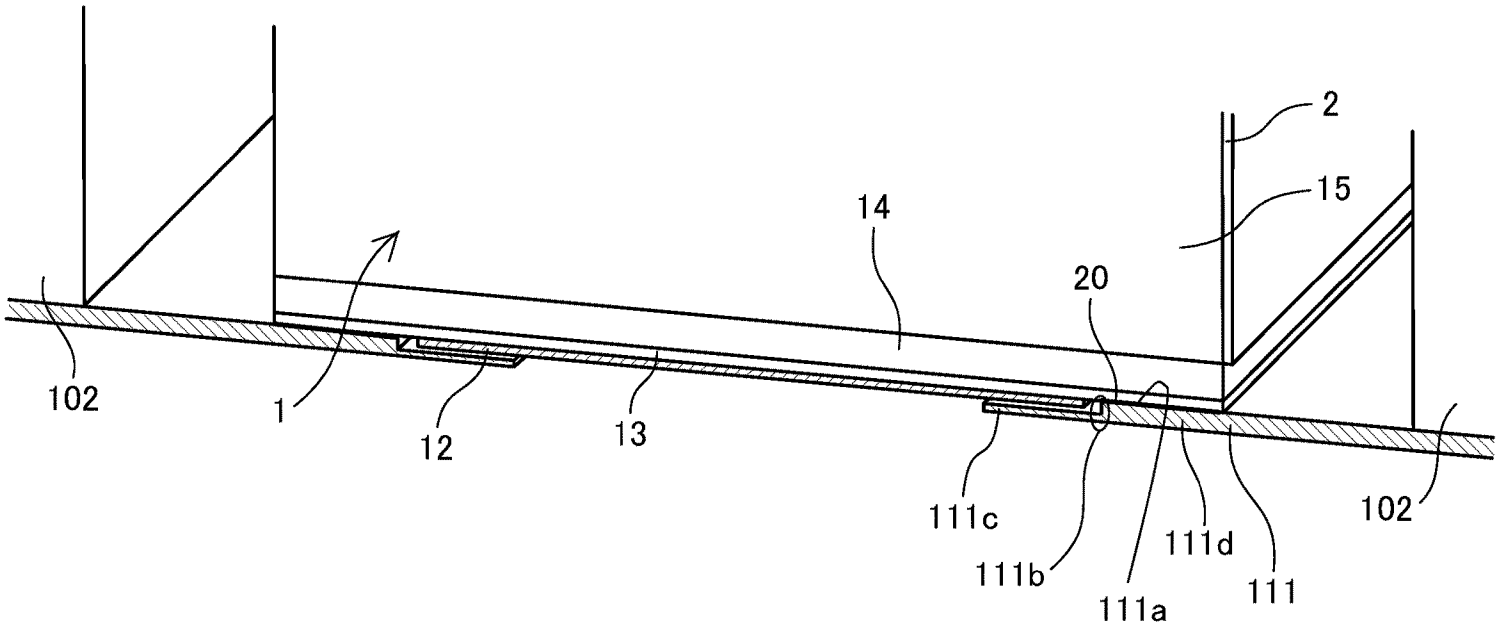
FIG. 14 is an enlarged perspective view of a part of the head module according to the third embodiment.

Next, a third embodiment of the present disclosure is described with reference to FIGS. 12 to 14. FIG. 12 is an outer perspective view of the head module according to the third embodiment. FIG. 13 is a cross-sectional perspective view of the head module according to the third embodiment. FIG. 14 is an enlarged perspective view of a part of the head module according to the third embodiment.

In this embodiment, one head 1 and one cover 111 are provided. Other configurations regarding one head 1 are similar to those in the first embodiment, so that the description thereof is omitted.

Figure 15:
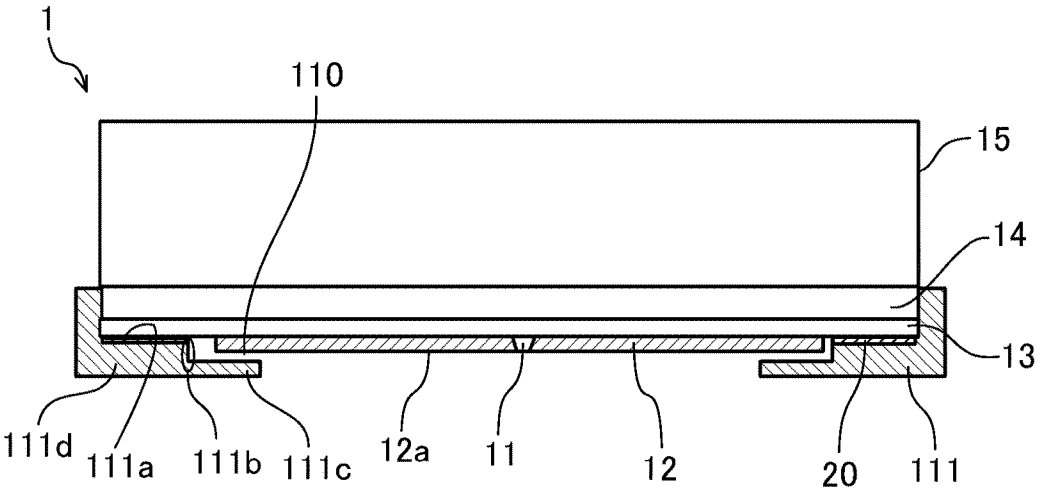
FIG. 15 is a side view of a liquid discharge head according to a fourth embodiment of the present disclosure.

Next, a fourth embodiment of the present disclosure is described with reference to FIG. 15. FIG. 15 is a side view of a liquid discharge head according to the fourth embodiment.

A head 1 includes a cover 111 bonded to a channel substrate 13 with an adhesive 20. Since the configuration of the cover 111 and the bonding of the cover 111 to the channel substrate 13 are similar to the configurations of the first embodiment, description thereof is omitted.

Figure 16A:
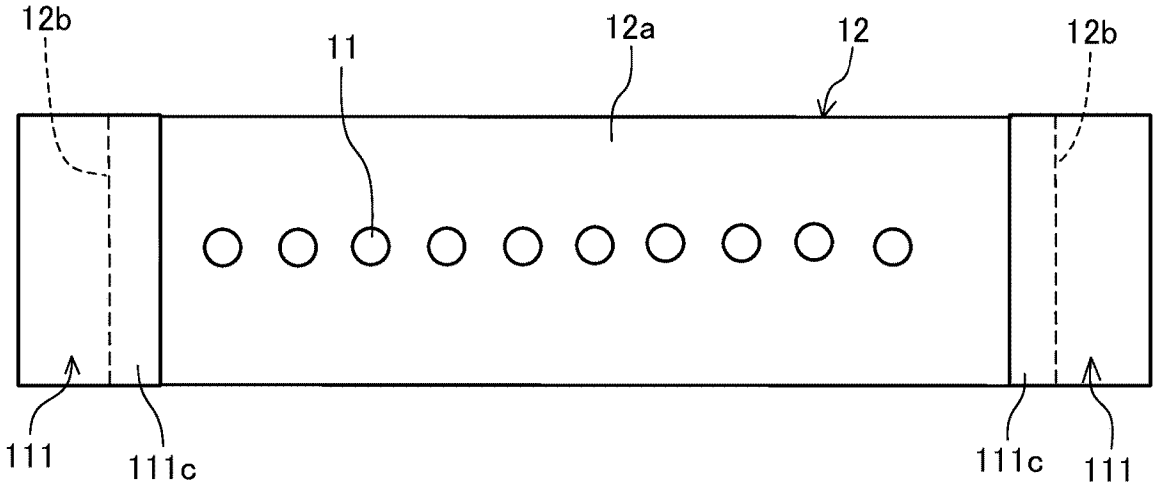
FIGS. 16A and 16B are plan views of a nozzle surface portion of one head according to a fifth embodiment of the present disclosure.
Figure 16B:
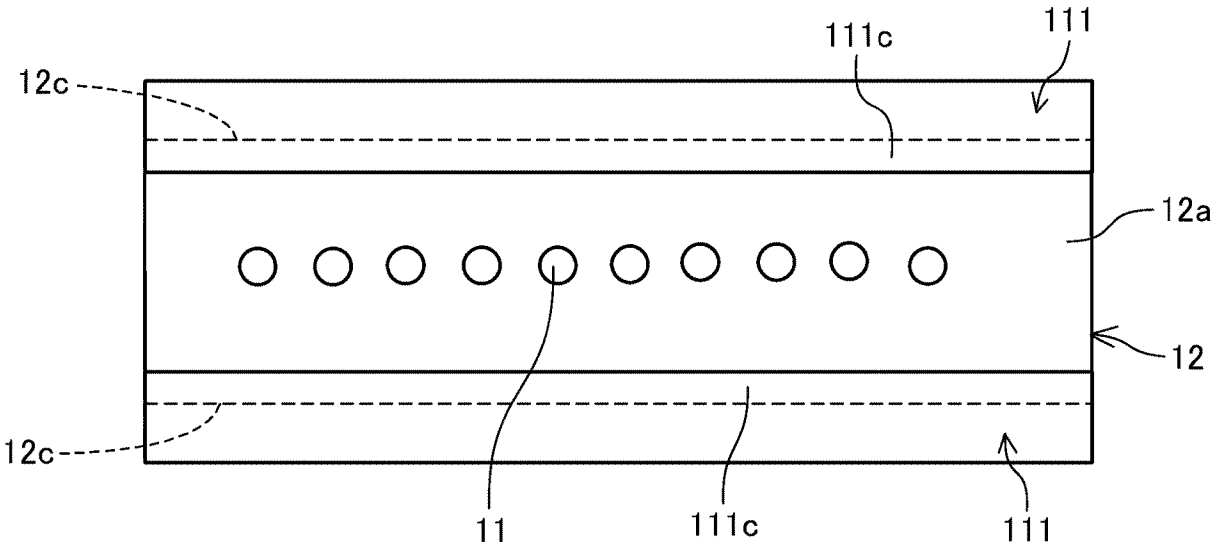

Next, different examples of a fifth embodiment of the present disclosure are described with reference to FIGS. 16A and 16B. FIGS. 16A and 16B are plan views of a nozzle surface portion of one head according to the fifth embodiment.

In a first example illustrated in FIG. 16A, covers 111 that cover peripheral edges of short sides 12*b* and 12*b* of a nozzle plate 12 are provided.

In a second example illustrated in FIG. 16B, covers 111 that cover peripheral edges of long sides 12*c* and 12*c* of the nozzle plate 12 are provided.

That is, in this embodiment, the covers 111 cover the peripheral edges of a pair of opposed sides of the discharge surface 12*a* of the nozzle plate 12.

Figure 17:
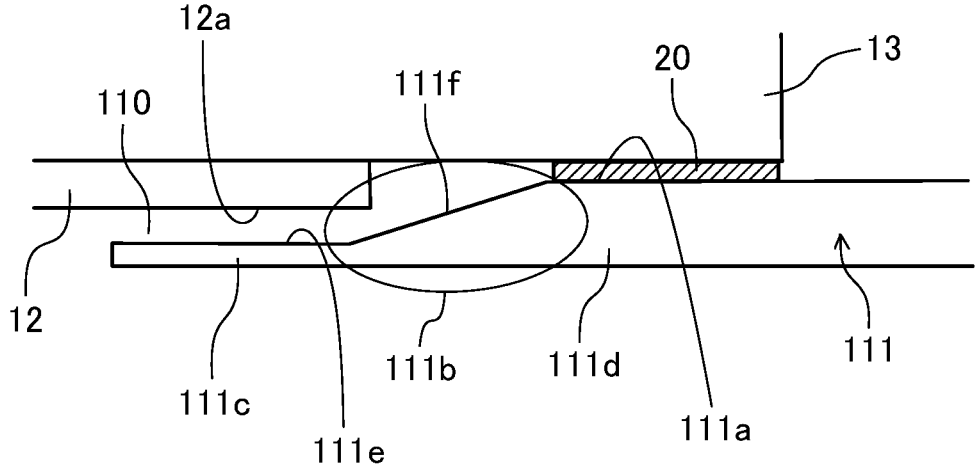
FIG. 17 is a cross-sectional view of a bonding portion between a head and a cover in a sixth embodiment of the present disclosure.

Next, a sixth embodiment of the present disclosure is described with reference to FIG. 17. FIG. 17 is a cross-sectional view of a bonding portion between a head and a cover in the sixth embodiment.

In this embodiment, a connecting surface 111*f* that connects a bonded surface 111*a* and an opposite surface 111*e* of a step portion 111*b* of a cover 111 is an inclined surface.

With such a configuration, it becomes possible to make liquid that enters a gap 110 between the cover 111 and a nozzle plate 12 less susceptible to accumulate. As a result, it is possible to suppress the liquid from coming into contact with an adhesive 20 and to reduce deterioration of the adhesive 20.

Figure 18:
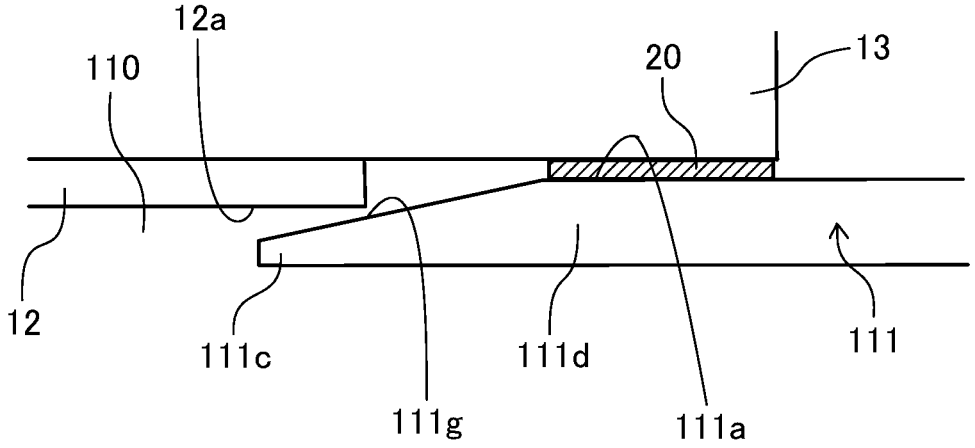
FIG. 18 is a cross-sectional view of a bonding portion between a head and a cover in a seventh embodiment of the present disclosure.

Next, a seventh embodiment of the present disclosure is described with reference to FIG. 18. FIG. 18 is a cross-sectional view of a bonding portion between a head and a cover in the seventh embodiment.

In this embodiment, a cover 111 is not provided with a step but is provided with an inclined surface 111*g* opposite a discharge surface 12*a* of a nozzle plate 12 from a bonded surface 111*a*.

With such a configuration, liquid is less likely to accumulate in a gap 110.

Figure 19:
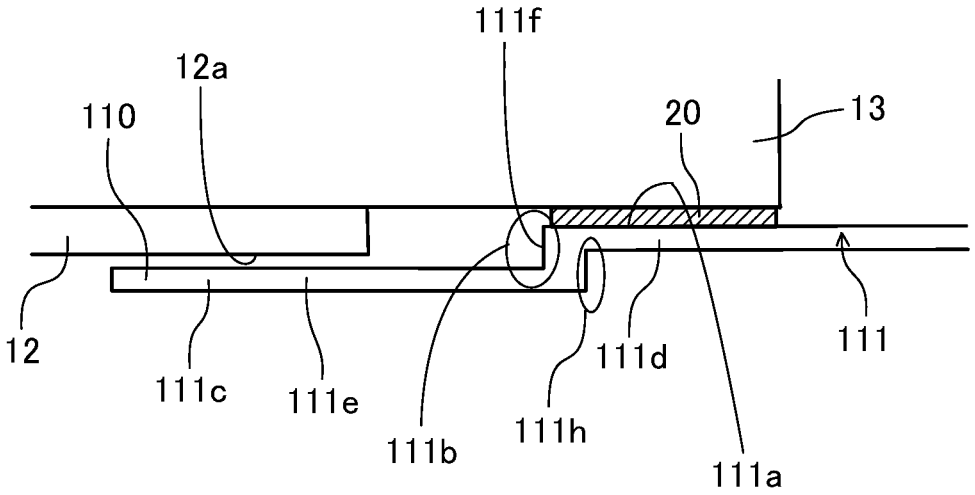
FIG. 19 is a cross-sectional view of a bonding portion between a head and a cover in an eighth embodiment of the present disclosure.

Next, an eighth embodiment of the present disclosure is described with reference to FIG. 19. FIG. 19 is a cross-sectional view of a bonding portion between a head and a cover in the eighth embodiment.

In this embodiment, a step portion 111*h* is also provided on a side opposite to a channel substrate 13 corresponding to a step portion 111*b* on a channel substrate 13 side of a cover 111.

With such a configuration, the cover may be formed of a plate material with a constant thickness.

Figure 20:
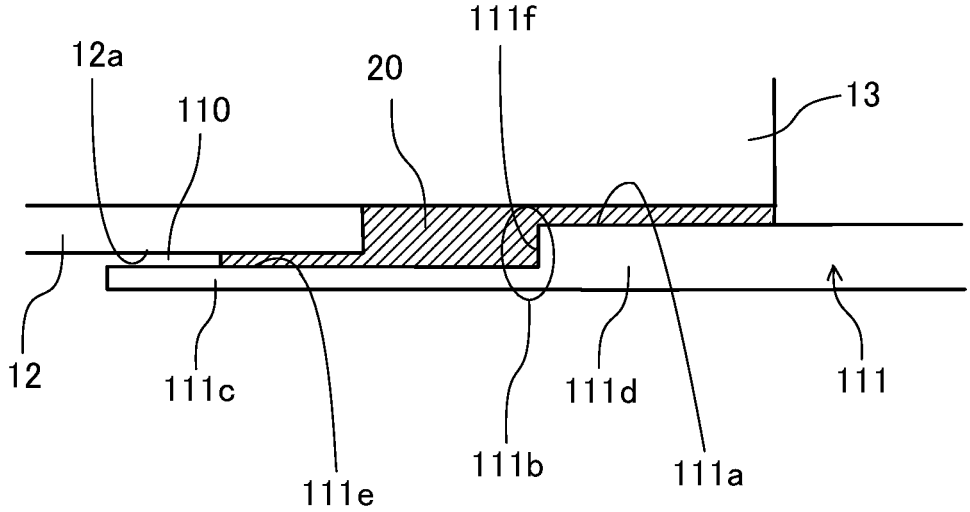
FIG. 20 is a cross-sectional view of a bonding portion between a head and a cover in a ninth embodiment of the present disclosure.

Next, a ninth embodiment of the present disclosure is described with reference to FIG. 20. FIG. 20 is a cross-sectional view of a bonding portion between a head and a cover in the ninth embodiment.

In this embodiment, a gap 110 between a cover 111 and a nozzle plate 12 is filled with an adhesive 20.

As a result, it is possible to surely prevent liquid adhering to a discharge surface of the nozzle plate 12 from entering a bonding portion between a channel substrate 13 and the cover 111, so that a sealing performance is improved.

The configurations of the above-described fifth to ninth embodiments may also be applied to both the head module and the head.

Figure 21:
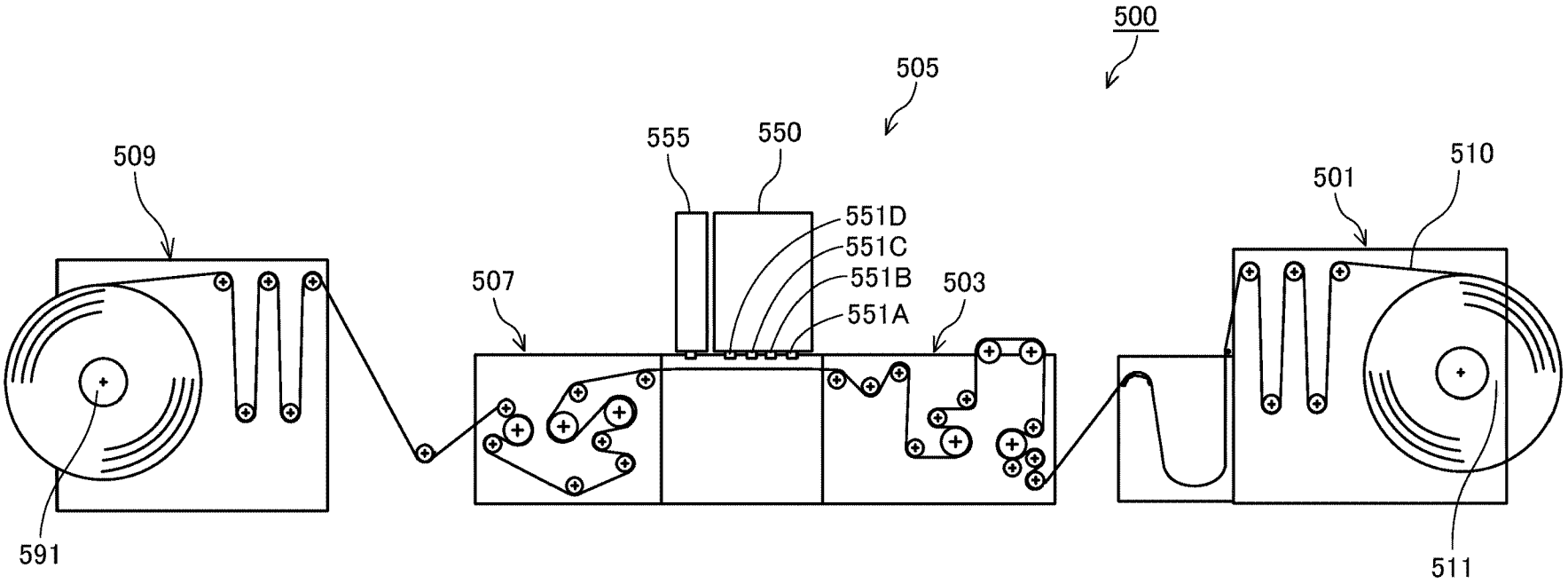
FIG. 21 is a schematic diagram of an example of a liquid discharge apparatus according to an embodiment of the present disclosure.
Figure 22:
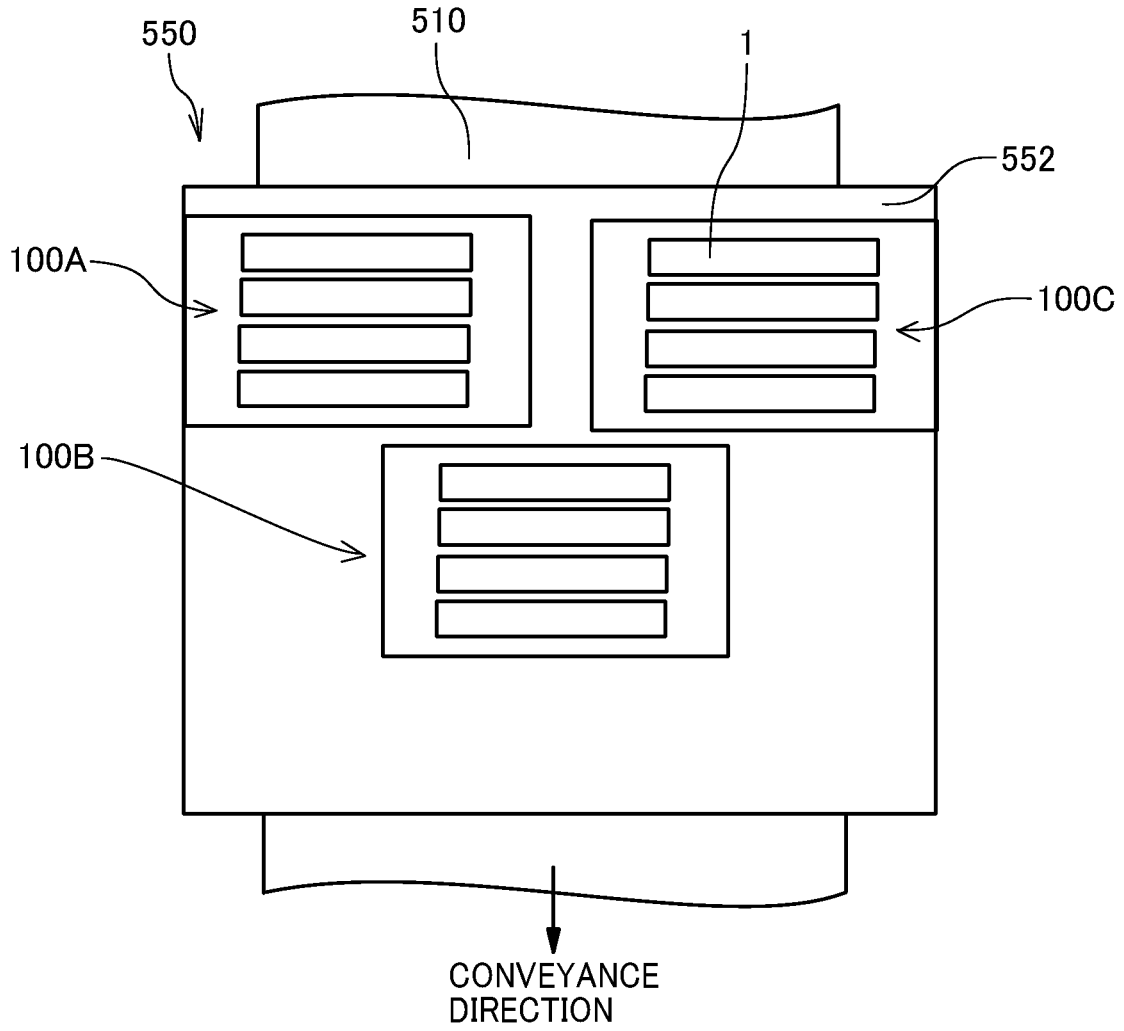
FIG. 22 is a plan view of an example of a head unit of the apparatus illustrated in FIG. 21.

Next, an example of a liquid discharge apparatus according to an embodiment of the present disclosure is described with reference to FIGS. 21 and 22. FIG. 21 is a schematic diagram of the liquid discharge apparatus. FIG. 22 is a plan view of an example of a head unit of the liquid discharge apparatus.

A printing apparatus 500 being the liquid discharge apparatus according to the present embodiment includes a loader 501 that loads a continuous body 510, a guiding conveyor 503 that guides and conveys the continuous body 510 loaded from the loader 501 to a printer 505, the printer 505 that prints to discharge liquid to the continuous body 510 to form an image, a dryer 507 that dries the continuous body 510, and an unloader 509 that unloads the continuous body 510.

The continuous body 510 is sent out from an original wind roller 511 of the loader 501, and guided to be conveyed by rollers of the loader 501, the guiding conveyor 503, the dryer 507, and the unloader 509 to be wound up by a wind-up roller 591 of the unloader 509.

The continuous body 510 is conveyed so as to be opposite a head unit 550 and an image is printed thereon by the liquid discharged from the head unit 550 in the printer 505.

Herein, the head unit 550 includes three head modules 100A, 100B, and 100C according to an embodiment of the present disclosure on a common base 552 as illustrated in FIG. 15.

In the present application, when the head is the liquid discharge head, the discharged liquid is not limited in particular as long as this has viscosity and surface tension such that this may be discharged from the head, but the viscosity is preferably 30 mPa·s or less at room temperature under a normal pressure, or by heating and cooling. More specifically, this includes solutions, suspensions, emulsions or the like including solvents such as water and organic solvents, colorants such as dyes and pigments, functional materials such as polymerizable compounds, resins, and surfactants, biocompatible materials such as deoxyribonucleic acid (DNA), amino acids, proteins, and calcium, and edible materials such as natural pigments; they may be used as, for example, inkjet inks, surface treatment liquids, forming liquids of components of electronic elements and light emitting elements, and electronic circuit resist patterns, and three-dimensional fabricating material liquids.

The liquid discharge apparatus includes an apparatus that includes the head module, the head unit and the like, and drives the head to discharge the liquid. Examples of the liquid discharge apparatus include not only an apparatus capable of discharging the liquid to a material to which the liquid may adhere but also an apparatus which discharges the liquid toward gas or into liquid.

The "liquid discharge apparatus" may include devices relating to feeding, conveying, and ejecting the material to which the liquid may adhere and also include a pre-treatment device and a post-treatment device.

For example, examples of the "liquid discharge apparatus" include an image forming apparatus which discharges ink to form an image on paper, and a stereoscopic fabrication apparatus (three-dimensional fabrication apparatus) which discharges fabrication liquid to a powder layer obtained by forming powder into a layer for fabricating a stereoscopic fabrication object (three-dimensional fabrication object).

The "liquid discharge apparatus" is not limited to an apparatus which visualizes a meaningful image such as a character and a figure by the discharged liquid. For example, an apparatus that forms a meaningless pattern, or an apparatus that fabricates a three-dimensional image are also included.

The "material to which the liquid may adhere" described above is intended to mean the material to which the liquid may adhere at least temporarily, the material to which the liquid adheres to be fastened, or the material to which the liquid adheres to permeate. Specific examples include recording media such as paper, recording paper, paper for recording, a film, and cloth, electronic components such as an electronic substrate and a piezoelectric element, and media such as a powder layer (powder layer), an organ model, and a testing cell. All the materials to which the liquid adheres are included unless limited in particular.

Materials of the above-described "material to which the liquid may adhere" may be any material as long as the liquid may adhere thereto even if temporarily such as paper, thread, fiber, cloth, leather, metal, plastic, glass, wood, and ceramics.

The "liquid discharge apparatus" includes an apparatus in which the liquid discharge head and the material to which the liquid may adhere move relative to each other; however, this is not limited to such an apparatus. Specific examples include a serial type apparatus in which the liquid discharge head is moved, and a line type apparatus in which the liquid discharge head is not moved.

The "liquid discharge apparatus" also includes a processing liquid applying apparatus that discharges a processing liquid onto paper for applying the processing liquid to a surface of the paper for the purpose of modifying the surface of the paper, an injection granulating apparatus that injects a composition liquid obtained by dispersing row materials in solution through a nozzle to granulate raw material fine particles and the like.

The terms of "image formation", "recording", "printing", "fabrication" and the like used in this application are synonyms.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A head module comprising:

a head including:

a nozzle plate including a nozzle configured to discharge liquid from a discharge surface of the nozzle plate; and a channel substrate including an individual channel communicated with the nozzle, the channel substrate having a surface facing the nozzle plate; and a cover covering at least one side of the discharge surface of the nozzle plate of the head, wherein an outer shape of the nozzle plate is smaller than an outer shape of the channel substrate, the cover has a bonded surface bonded to the surface of the channel substrate in an outer area of the nozzle plate with an adhesive, and the bonded surface of the cover is closer to the channel substrate than the discharge surface of the nozzle plate is.

2. The head module according to claim 1, wherein the cover includes:

an opposite portion opposite the discharge surface of the nozzle plate;

a bonded portion bonded to the channel substrate; and a step portion between the opposite portion and the bonded portion.

3. The head module according to claim 2, wherein at the step portion, the opposite portion is thinner than the bonded portion.

4. The head module according to claim 2, wherein the step portion includes a connecting portion connecting the opposite portion and the bonded portion, and the connecting portion is inclined.

5. The head module according to claim 1, wherein there is a gap between the discharge surface of the nozzle plate and an opposite area of the cover opposite the discharge surface of the nozzle plate.

6. The head module according to claim 1, wherein a gap between the discharge surface of the nozzle plate and an opposite area of the cover opposite the discharge surface of the nozzle plate is filled with the adhesive bonding the cover to the channel substrate.

7. The head module according to claim 1, further comprising:

a plurality of heads including the head; and the cover.

8. A head unit comprising:

a common base; and a plurality of head modules, including the head module according to claim 1, on the common base.

9. A liquid discharge apparatus comprising the head unit according to claim 8.

10. A liquid discharge apparatus comprising the head module according to claim 1.

11. A liquid discharge head comprising:

a nozzle plate including a nozzle configured to discharge liquid from a discharge surface of the nozzle plate;

a channel substrate including an individual channel communicated with the nozzle, the channel substrate having a surface facing the nozzle plate; and a cover covering at least one side of the discharge surface of the nozzle plate, wherein an outer shape of the nozzle plate is smaller than an outer shape of the channel substrate, the cover has a bonded surface bonded to the surface of the channel substrate in an outer area of the nozzle plate with an adhesive, and the bonded surface of the cover is closer to the channel substrate than the discharge surface of the nozzle plate is.

12. The liquid discharge head according to claim 11, wherein the cover includes:

an opposite portion opposite the discharge surface of the nozzle plate;

a bonded portion bonded to the channel substrate; and a step portion between the opposite portion and the bonded portion.

13. The liquid discharge head according to claim 12, wherein at the step portion, the opposite portion is thinner than the bonded portion.

14. The liquid discharge head according to claim 12, wherein the step portion includes a connecting portion connecting the opposite portion and the bonded portion, and the connecting portion is inclined.

15. The liquid discharge head according to claim 11, wherein there is a gap between a peripheral edge of the discharge surface of the nozzle plate and an opposite area of the cover opposite the discharge surface of the nozzle plate.

16. The liquid discharge head according to claim 11, wherein a gap between the discharge surface of the nozzle plate and an opposite area of the cover opposite the discharge surface of the nozzle plate is filled with the adhesive bonding the cover to the channel substrate.

17. A liquid discharge apparatus comprising the liquid discharge head according to claim 11.

* * * * *